US005454286A

United States Patent [19]

Takaha

[11] Patent Number: 5,454,286

[45] Date of Patent: Oct. 3, 1995

[54] CUTTER FOR CUTTING A CONTINUOUS CORRUGATED STRIP

[75] Inventor: Naoki Takaha, Handa, Japan

[73] Assignee: Nippondenso Co., Ltd., Kariya, Japan

[21] Appl. No.: 186,914

[22] Filed: Jan. 27, 1994

[30] Foreign Application Priority Data

Feb. 22, 1993 [JP] Japan ..... 5-032202

[51] Int. Cl.[6] ..... B21D 13/04; B26D 7/06; B26D 1/56; B23D 25/12

[52] U.S. Cl. ..... 83/346; 83/156; 83/423; 72/185

[58] Field of Search ..... 72/185, 186, 187; 83/337, 346, 156, 346, 423

[56] References Cited

U.S. PATENT DOCUMENTS

| | | | |
|---|---|---|---|
| 1,304,034 | 5/1919 | Edwards . | |
| 1,365,258 | 1/1921 | Lundin | 72/186 |
| 2,405,204 | 8/1946 | Goodrich . | |
| 2,761,513 | 9/1956 | Stram . | |
| 3,263,465 | 8/1966 | Way . | |
| 3,367,161 | 2/1968 | Avakiam . | |
| 3,625,099 | 12/1971 | Mase et al. | 83/346 |
| 3,693,710 | 9/1972 | Drosnin . | |
| 4,685,318 | 8/1987 | Ueda et al. . | |
| 4,956,987 | 9/1990 | Hara et al. . | |

FOREIGN PATENT DOCUMENTS

| | | |
|---|---|---|
| 60-48212 | 3/1985 | Japan . |
| 61-117008 | 6/1986 | Japan . |
| 61-159319 | 7/1986 | Japan . |
| 61-260907 | 11/1986 | Japan . |
| 236091 | 2/1990 | Japan . |
| 678029 | 8/1952 | United Kingdom . |

*Primary Examiner*—Lowell A. Larson
*Assistant Examiner*—Rodney A. Butler
*Attorney, Agent, or Firm*—Cushman, Darby & Cushman

[57] ABSTRACT

A cutter for cutting a continuous corrugated strip includes a feed gear, on the outer circumference of which a tooth portion engaging with a continuous corrugated strip such as a corrugated fin used for a radiator is provided, wherein a tooth cutout portion is formed in the feed gear. In a cavity formed in the feed gear, a first cutting blade unit rotated around an eccentric center is accommodated. When a first cutting blade radially provided in the first cutting blade unit is projected from the tooth cutout portion, the first cutting blade comes into contact with a second cutting blade provided outside, so that the continuous corrugated strip can be cut.

7 Claims, 6 Drawing Sheets

CUTTER FOR CUTTING A CONTINUOUS CORRUGATED STRIP

BACKGROUND OF THE INVENTION

1. Field of the Invention

The present invention relates to a cutter for cutting a continuous corrugated strip. For example, the cutter of the present invention can be used for cutting a corrugated fin used for an automotive radiator or heater into sections having a predetermined length (by a predetermined number of ridges of the corrugated fin).

2. Description of Prior Art

The core of certain types of heat exchangers such as an automotive radiator or heater is manufactured when corrugated fins are welded or soldered to form water tubes. Corrugated fins are obtained when a continuous metallic strip is formed into a wave-shape by a pair of toothed forming rollers or forming gears to form a continuous corrugated strip, which is then sheared by a cutter into sections having a predetermined length (by a predetermined number of ridges of the corrugated fin). For the manufacture of fins on a mass production basis, it is necessary for a cutter to operate at as high speed as possible to shear a corrugated strip discharged continuously at high speed from the forming rollers. Further, the length of corrugated fins varies depending upon the size of the radiator cores to be manufactured. Therefore, it is necessary for the cutter to cut the continuous corrugated strip precisely to obtain a series of strip sections having a desired length.

An example of conventional cutters is disclosed in the specification of U.S. Pat. No. 4,685,318 (or Japanese Unexamined Patent Publication No. 61-159319). This type of apparatus is called a rotary cutter, in which a fixed cutting blade is provided to one of a pair of gears which are opposed to each other and rotated in synchronization with each other, and a movable cutting blade capable of projecting toward the fixed cutting blade is provided to the other gear. When the continuous corrugated fin passing between the opposed gears is cut, the movable cutting blade is projected toward the fixed cutting blade so that the continuous corrugated fin is pinched and cut by the movable and fixed cutting blades like a guillotine.

However, in this type of conventional rotary cutter, the fixed and movable cutting blades are respectively provided to a pair of opposed gears which are synchronously rotated. Therefore, in order to cut the corrugated fin when the two cutting blades collide with each other, that both cutting blades must be shaped and assembled accurately because they are engaged at one point where the outer circles of the opposed gears are in contact with each other. Consequently, it is necessary to use highly accurate parts and assembling techniques, so that the production costs of the conventional apparatus are high.

According to the first conventional technique described above, the cutting blades meet each other at one point on the circumference, at a relative speed of zero, so that the corrugated fin is cut while being pushed by the cutting blades, that is, the first conventional technique is of the push-cutting type. Therefore, the edges of the cutting blades are worn away in a short period of time. The worn edge causes the cutting ability of the blades to deteriorate.

The further problem is that the guillotine type cutter is capable of cutting corrugated fins made of low-ductility materials such as aluminum but is not capable of high-ductility materials such as copper, or thin or wide corrugated fins.

In order to solve the above problems, a cutter is proposed in the specification of U.S. Pat. No. 4,956,987 (or Japanese Unexamined Patent Publication No. 2-36091). A cutter according to a second technique described in these publications utilizes a means which can be called a rotary pinch-cutting type mechanism. As illustrated in FIG. 2, this mechanism includes: several first cutting blades 101 capable of moving in radial slits 108 formed in a feed gear 103; and a second cutting blade 102 capable of moving vertically, wherein the second cutting blade 102 is disposed at a cutting position where the second cutting blade 102 is opposed to the first cutting blade 101. When the first cutting blade 101 is projected onto the outer circumference of the feed gear 103 by the action of a cam 104 in accordance with the rotation of the feed gear 103, the second cutting blade 102 is lowered by the action of another cam 105. In this way, a fin 110 is conveyed between the two cutting blades 101 and 102 while the fin is being cut in its width direction. In this case, the first cutting blades 101 which are not in the cutting position are disposed at retracted positions close to the center of the feed gear 103. Therefore, the first cutting blades 101 do not interfere with guide members 109*a*, 109*b*.

However, in the cutter according to the second conventional technique, it is necessary to use a large number of highly accurate parts and dimensions such as: an engaging portion between the first cutting blade 101 and the radial slit 108, an engaging portion between a roller 106 for driving the first cutting blade 101 and a pin 107 for rotatably supporting the first cutting blade 101, an outside diameter of the roller 106, and a height from the center of the pin 107 to the edge of the first cutting blade 101. Therefore, the following problems may be encountered:

The manufacturing costs are increased. It is difficult to increase the operation speed. Problems are caused when chips or debris enter the slits 108. Finally, maintenance of the device is difficult.

Since the cutting machine shown in FIG. 2 is not provided with a mechanism to release an excessive cutting load generated when the upper and lower cutting blades 101, 102 collide with each other, the reliability of the cutting machine is low, and the life of the cutting blades is not long.

SUMMARY OF THE INVENTION

It is an object of the present invention to solve the foregoing problems of the conventional cutter for cutting a continuous corrugated strip.

In order to accomplish the above object, the present invention provides a cutter for cutting a continuous corrugated strip, comprising: a frame; a feed gear rotatably supported by the frame, the feed gear being provided with a tooth portion on its outer circumference so as to be engageable with a continuous corrugated strip to be cut, a tooth cutout portion being formed in a portion of the outer circumference; a rotary drive means for rotating the drive gear; a first cutting blade unit having at least one first cutting blade capable of projecting from the tooth cutout portion of the feed gear, the first cutting blade unit being capable of rotating on an axis eccentric to the center of the feed gear; a rotary drive means for rotating the first cutting blade unit synchronously with the rotation of the feed gear; and a second cutting blade which is opposed to an edge of the first cutting blade and shears the continuous corrugated strip in cooperation with the first cutting blade when the first cutting blade is projected from the tooth cutout portion of the feed gear According to the cutter of the present invention, it is possible to reduce the number and area of sliding portions and the number of highly accurate parts. Therefore, the manufacturing costs can be lowered, and the durability and reliability of the apparatus can be improved. Further, according to the present invention, a cam to drive the first cutting blade is removed, and the first cutting blade is driven by the action of a simple rotational movement. Consequently, the speed of cutting operation of the cutter of the invention can be faster than the conventional cutter. Furthermore, a mechanism is added so as to release an excessive cutting load generated when the first and second cutting blades collide with each other, so the life of the cutting blades can be greatly improved, and the manufacturing accuracy of the blades can be relaxed. Furthermore, man-hours necessary for adjustment of the apparatus can be greatly reduced.

Other objects and effects of the present invention will be more apparent to those skilled in the art on consideration of the accompanying drawings and following specification in which several exemplary embodiments of the invention are disclosed.

BRIEF DESCRIPTION OF THE DRAWINGS

In the detailed description of the preferred embodiments of the invention presented below, reference is made to the accompanying drawings in which.

DETAILED DESCRIPTION OF THE PREFERRED EMBODIMENT

The present invention will be described below with particular reference to an example in which a cutter of the present invention is used for cutting a continuous corrugated fin used in an automotive radiator.

Figure 3:
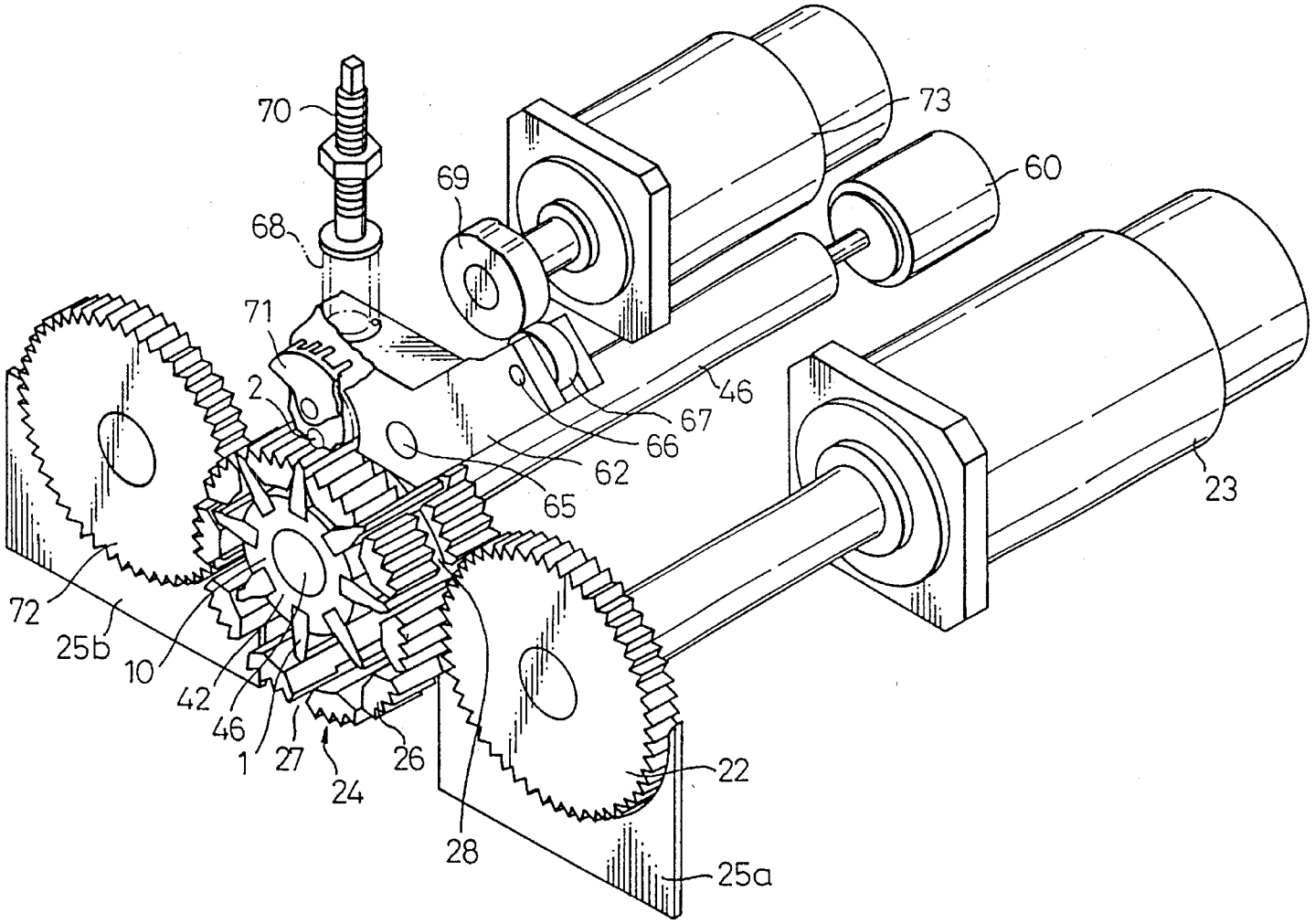
FIG. 3 is a perspective view showing a primary portion of a corrugated fin manufacturing apparatus which is an example of the present invention.
Figure 4:
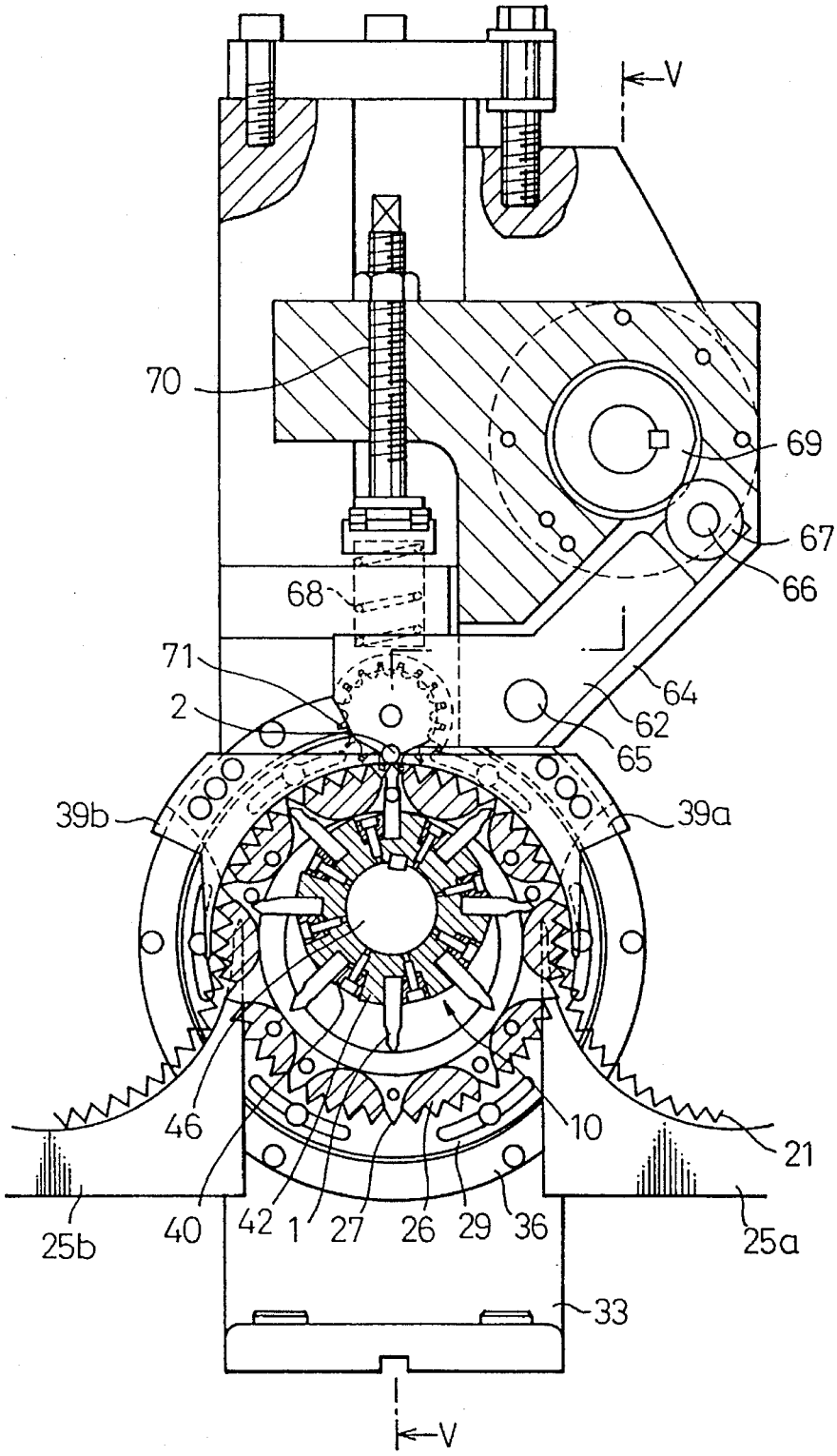
FIG. 4 is a sectional front view of the corrugated fin manufacturing apparatus shown in FIG. 3.
Figure 5:
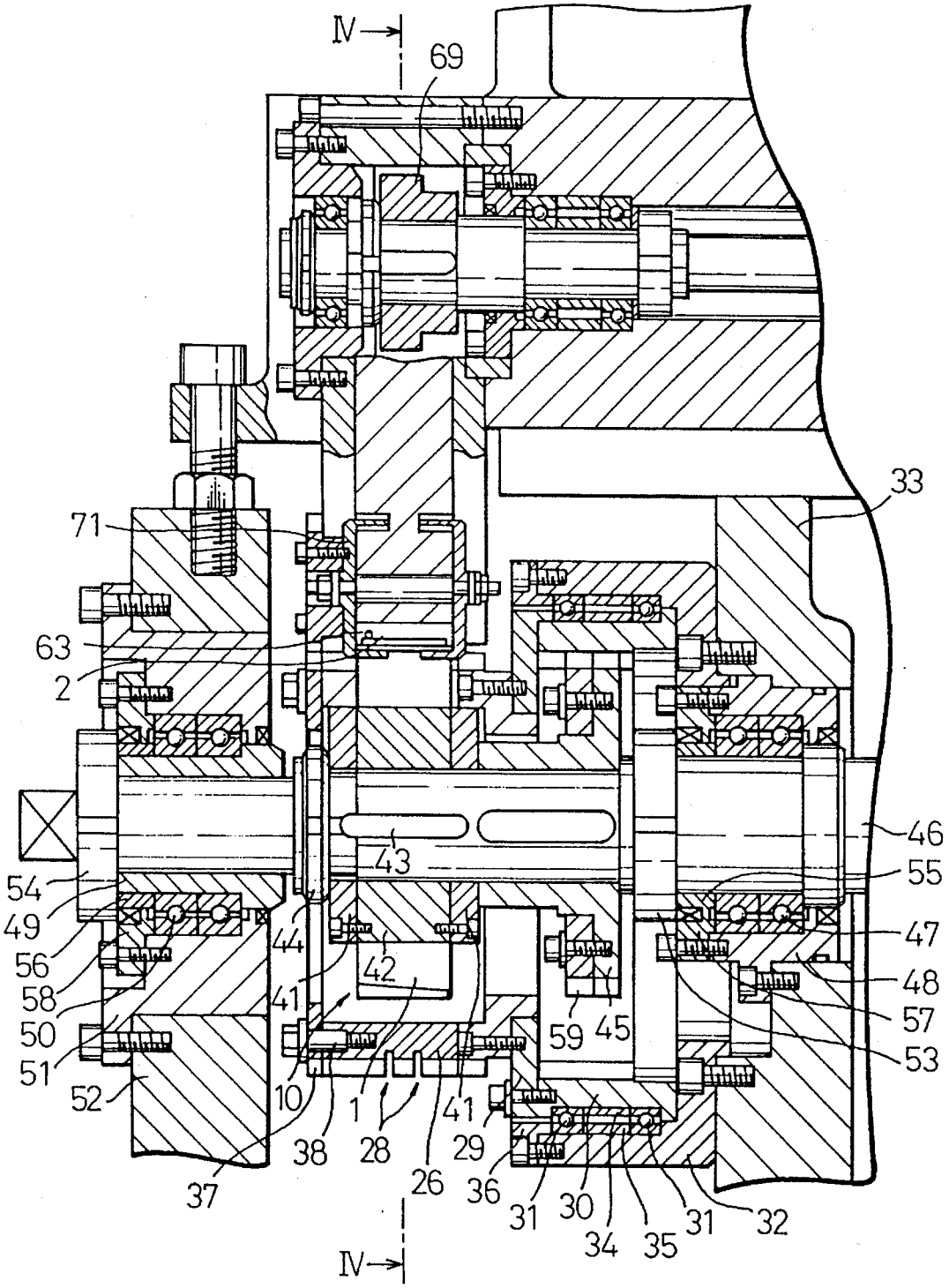
FIG. 5 is a sectional side view of the corrugated fin manufacturing apparatus shown in FIG. 3.

FIG. 3 is a perspective view of a primary portion of a corrugated fin manufacturing apparatus including the aforementioned cutting apparatus. FIG. 4 is a sectional front of the apparatus, wherein FIG. 4 is taken on line IV—IV in FIG. 5. FIG. 5 is a sectional side view of the apparatus, wherein FIG. 5 is taken on line V—V in FIG. 4. A continuous strip made of copper alloy or aluminum alloy for example, is supplied from a supply source not shown. The continuous strip is then passed through a pair of forming rollers (not shown) so as to be formed into a corrugated fin 21 which is a continuous corrugated strip. At the same time, the formed corrugated fin 21 is conveyed to a feed roller 22 by the rotation of the forming rollers. This continuous strip having into a wave-shape, (that is, the corrugated fin 21) is conveyed to a cutter 24 by the feed roller 22. On an outer circumference of the feed gear 22, a tooth portion is provided, which lightly holds and conveys the corrugated fin 21. The feed gear 22 is driven by an AC motor 23, for example, and is rotated synchronously with the forming rollers. Under the feed gear 22, a guide member **25*a* is provided, which guides the corrugated fin 21 so that the corrugated fin 21 is not disengaged from the tooth portion of the feed gear 22. Also, a guide member 25*b* is provided, which guides the corrugated fin 21** after it has been cut.

Next, the construction of the lower portion of the cutter 24 will be explained as follows.

The feed gear 26 is provided with a tooth portion on its outer circumference in the same manner as the feed gear 22. The feed gear 26 is rotatably meshed with the feed gear 22 at a predetermined position. In this case, as described later, the feed gear 26 is driven by the AC motor 23 through a gear train (not shown). Therefore, the feed gear 26 is not driven by the feed gear 22. Tooth cutout portions 27 are provided at regular intervals in the tooth portion formed on the outer circumference of the feed gear 26. In the example illustrated in the drawing, the number of teeth of the gear 26 is 50, and the tooth cutout portions 27 are formed every 5 teeth, so that 10 tooth cutout portions are formed in total. In the gear 26, a cavity is formed so that the cavity is communicates with the tooth cutout portions 27. Due to the foregoing, the front configuration of the section of the feed gear 26 is formed into a flower-shape as illustrated in FIG. 4. It is necessary that the guide members **25*a*, 25*b* for guiding the corrugated fin enter a position deeper than the tooth bottom of the feed gear 26. Therefore, at least one clearance groove 28 is formed on the outer circumference of the feed gear 26. As illustrated in FIGS. 4 and 5, the feed gear 26 is integrated with an inner gear 30 through a bearing cap 29. The inner gear 30 is rotatably supported by a bearing box 32 through a bearing 31. Also, the bearing box 32 is fixed to a frame 33 of the cutter 24. In this connection, numerals 34 and 35 denote spacers provided between the two bearings 31, and numeral 36 denotes a bearing cap. A split gear 37 composed of two semicircular parts is attached to the feed gear 26 with a positioning bolt 38. Further, as illustrated in FIG. 4, guide members 39*a* and 39*b* to guide a corrugated fin in an upper portion of the feed gear 26 are attached to the right and left upper portions of the feed gear 26**.

Figure 1:
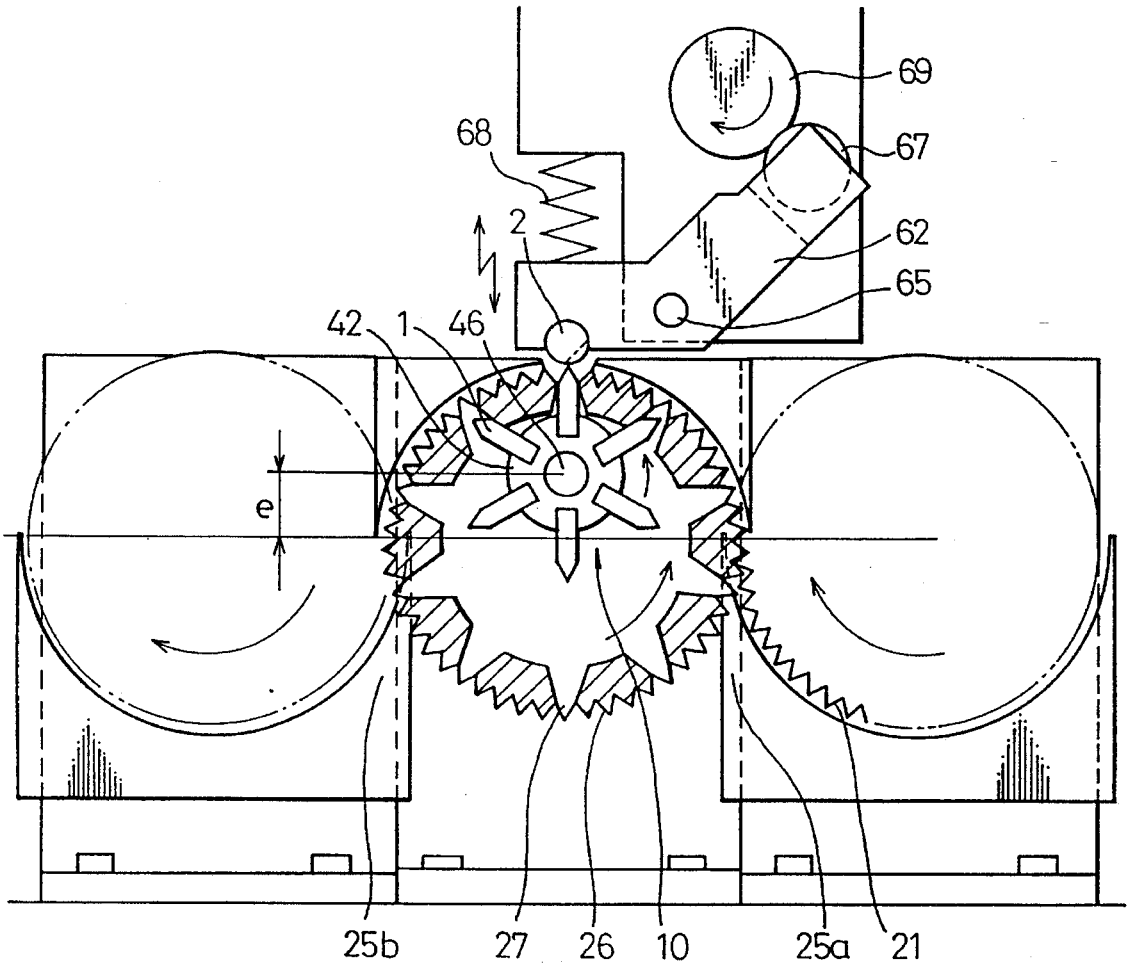
FIG. 1 is a sectional front view of the cutter of the present invention, wherein an outline of the construction of the cutter is exemplarily shown.
Figure 2:
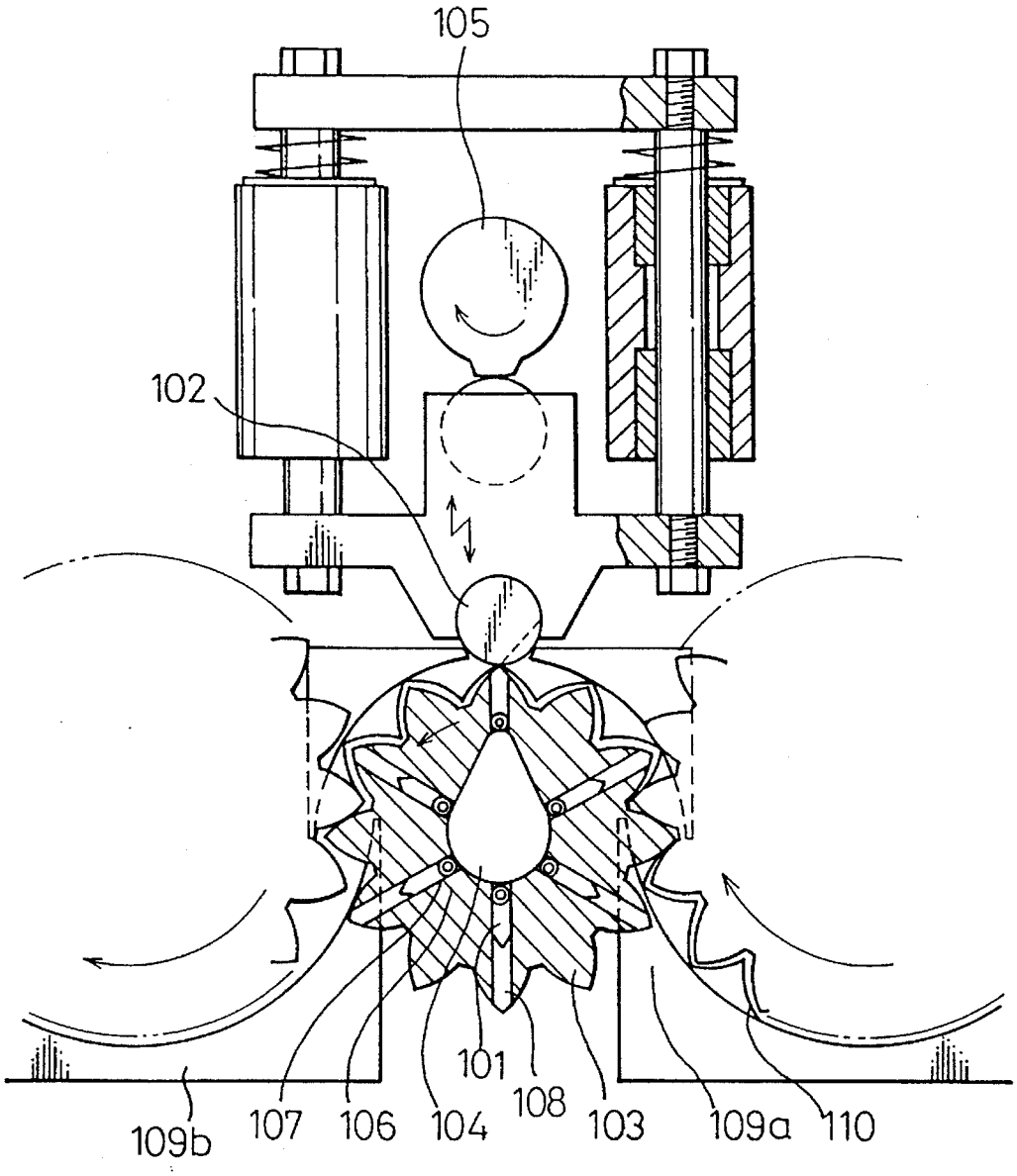
Fig. 2 PRIOR ART
FIG. 2 is a sectional front view of the conventional cutter, wherein the construction is exemplarily shown.

In the example illustrated in the drawings, eight pieces of the first cutting blades 1 are provided. The first cutting blade 1 is radially fixed onto a cutter holder 42 with a wedge 40 and plate 41. This assembly will be referred to as a first cutting blade unit 10, hereinafter. As illustrated in FIG. 5, the first cutting blade unit 10 is fastened to a shaft 46 by a key 43 and nut 44 together with a pinion 45. The shaft 46 is eccentric to the center of the inner gear 30 and feed gear 26 by a distance "e" as illustrated in FIG. 1. One end of the shaft 46 is rotatably supported by a bearing box 48 through a bearing 47, and the other end of the shaft 46 is rotatably supported by a bearing box 51 through a bearing 50. The bearing box 48 is fixed to the frame 33 of the cutter, and the bearing box 51 is fixed to a bracket 52 which has been accurately positioned with respect to the frame 33. In FIG. 5, numerals 53 and 54 are nuts for fastening the bearing, numerals 55 and 56 are collars for fastening the bearing, and numerals 57 and 58 are bearing covers.

Although not shown in the drawings, gear trains are provided in the frame 33 for the purpose of transmitting torque from the rotational shaft of the feed gear 22 (the shaft of the AC motor 23) to the shaft 46 and further transmitting torque to the feed gear 72. Therefore, the shaft 46 is rotated synchronously with the rotation of the feed gears 22 and 72, and drives the pinion gear 45 and the first cutting blade unit 10 in the opposite direction. At this time, since the pinion 45 is meshed with the inner gear 30, the inner gear 30 is driven, and since the feed gear 26 is connected with the inner gear 30, the feed gear 26 is concurrently driven. In this case, a pitch diameter (diameter of a pitch circle) of the inner gear 30 and that of the feed gear 26 are approximately the same. Therefore, a pitch diameter of the pinion 45 and that of the first cutting blade unit 10 are approximately the same. Consequently, when the AC motor 23 is driven, the feed gear 26 and the first cutting blade unit 10 eccentrically provided in the cavity formed in feed gear 26 are synchronously rotated at the same circumferential speed in the same direction. In this connection, in order to allow the feed gear 26 and the first cutting blade unit 10 to rotate synchronously, backlash between the inner gear 30 and the pinion 45 is eliminated by attaching an adjusting gear 59 to the pinion 45.

In order to allow the feed gear 26 and the first cutting blade unit 10 to rotate synchronously without interference, it is necessary, as described above, for the circumferential speeds to be the same. Moreover, it is also necessary to satisfy size constraint The constraint is that the first cutting blade 1 must coincide with the tooth cutout portion 27 of the gear 26 without fail, (that is, according to the example shown in the drawings), a circular pitch of the first cutting blade unit 10 is accurately 5 times as long as that of the feed gear 26.

When these two conditions are satisfied, the basic function required of the first cutting blade 1 can be realized only by rotary motions in the following manner:

When the first cutting blade unit 10 is rotated synchronously with the feed gear 26, the first cutting blade 1 slightly projects from an end of the tooth of the feed gear 26 by a distance about 0.5 mm at the uppermost position of the feed gear, which is the cutting position. As the first cutting blade 1 is moved away from the cutting position, it gradually retracts into the inside of the feed gear 26, and finally it is completely withdrawn into the cavity of the feed gear 26. When the first cutting blade 1 approaches the cutting position next time, it is again projected toward the outer circumference of the gear.

Due to the aforementioned basic function of the first cutting blade 1, it is possible to dispose the guide members 25a and 25b for guiding the fin, at positions where they do not interfere with the first cutting blade 1.

A rotary encoder 60 is provided on a lower side of the cutter 24. In accordance with the rotation of the shaft 46, the rotary encoder 60 always outputs electric pulses. Due to the foregoing, the number of ridges of the corrugated fin can be accurately counted while the corrugated fin is conveyed. As long as the number of ridges of the corrugated fin to be conveyed can be operatively counted, the setting position of a rotational detector such as a rotary encoder is not limited to a specific position. Therefore, the rotary encoder 60 is not necessarily mounted on the rotary shaft. In the example illustrated in the drawings, the rotary encoder 60 is mounted on the shaft 46 to drive the first cutting blade unit 10.

Figure 6:
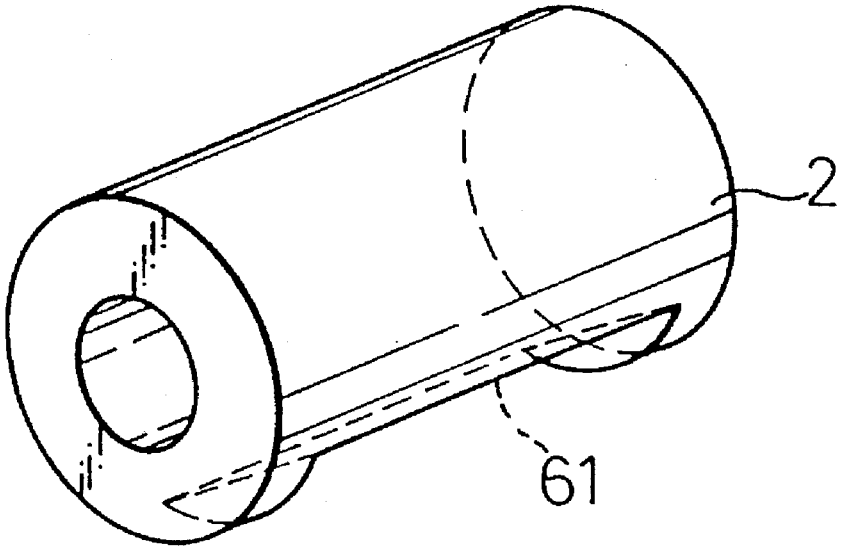
FIG. 6 is a perspective view exemplarily showing the second cutting blade.

Next, the construction of an upper portion of the cutter 24 will be explained as follows. When the first cutting blade 1 is located at the most upper position of the feed gear 26, which is the cutting position, the second cutting blade 2, which cuts the corrugated fin 21 in cooperation with the first cutting blade 1, is positioned just at an upper position of the feed gear 26. As illustrated in FIG. 6, this second cutting blade 2 is formed into a cylindrical configuration in which a portion is cut away. An edge of the cutaway portion composes a blade portion 61 of the second cutting blade 2. The second cutting blade 2 is fixed to the lower portion of a lever 62 by a pin 63. The lever 62 is rotatably supported by a fulcrum pin 65 fixed to a bracket 64. A roller follower 67 is rotatably supported by one end of the lever 62 through a pin 66.

As illustrated in FIG. 4, a spring 68 is provided at the other end of the lever 62. Due to the pushing force of the spring 68, a moment is given to the lever 62 around the fulcrum pin 65. Due to the foregoing, the roller follower 67 is always pushed to a cam 69 disposed at a diagonally upper position. The pushing force generated by the spring 68 can be optionally adjusted when an adjusting bolt 70 attached to the bracket 64 is rotated so as to change an amount of deflection of the spring 68. One of the objects of applying a force to the lever 62 with the spring 68 is to allow the roller follower 67 to contact with an end surface of the cam 69 at all times so as to accurately move the lever 62 in accordance with a curve of the cam 69. The other object is to set an upper limit of the cutting force generated between the first and second cutting blades 1 and 2. Therefore, the pushing force given by the spring 68 must be determined in accordance with various factors such as the rotational speed, acceleration and stroke of the cam 69, the allowable load of the roller follower 67, and the most appropriate cutting load determined by the cutting capacity and life of the blade. In this connection, numeral 71 is a rotary pin wheel for forcibly conveying the corrugated fin, wherein the rotary pin wheel holds an end of the corrugated fin which has been cut, so that the corrugated fin does not contact with the second cutting blade 2.

Next, the operation of the cutter 24 constructed in the manner described above will be explained in the case where a corrugated fin is actually cut.

The corrugated fin 21 is manufactured when a supplied metallic strip is continuously formed into a wave form by a pair of forming rollers (not shown). While the corrugated fin 21 is guided by the guide member 25*a*, it is conveyed by the feed gear 22. After the corrugated fin 21 has been transferred to the synchronously rotating gear 26, it is conveyed to the feed gear 72, guided by the guide member 39*a*.

In this case, at a position where the corrugated fin 21 is transferred to the feed gear 26 from the feed gear 22, the first cutting blade 1 is completely withdrawn into the cavity formed in the feed gear 26 so that the first cutting blade 1 can not interfere with the guide member 25*a*. At a cutting position, the first cutting blade 1 is projected from a fore end of the tooth of the feed gear 26 so that cutting can be performed.

While the first cutting blade unit 10 is rotated, the first cutting blade 1 continuously conducts the aforementioned motions on the feed gear 26. Therefore, the first cutting blade 1 is put into a cutting condition every 5 ridges of the corrugated fin 21. Consequently, in order to cut the corrugated fin 21, it is necessary to lower the second cutting blade 2 to a cutting position every predetermined number of ridges of the corrugated fin 21, wherein the second cutting blade 2 is usually raised to a high position where the corrugated fin 21 can not be cut.

The cutting operation is conducted by the second cutting blade 2 in the following manner:

The cam 69 is driven by a servo motor 73 according to the passage of a predetermined number of ridges of the corrugated fin 21. Therefore, it becomes possible to rotate the lever 62 by the force of the spring 68. A revolution number detector, such as a rotary encoder 60 provided in the lower unit of the cutter 24, always counts the number of ridges of the conveyed corrugated fin 21. In this way, it can be detected that the corrugated fin 21 has been conveyed by a predetermined number of ridges.

That is, the cutting system of this cutter 24 is described as follows:

While the corrugated fin 21 is being conveyed by the feed gear 26, the number of ridges of the corrugated FIG. 21 is counted. When the first cutting blade unit 10 is rotated at an eccentric position, the first cutting blade 1 is disposed at a cutting position, and at the same time, the servo motor 73 is driven every predetermined number of ridges of the corrugated fin 21, so that the second cutting blade 2 is lowered by the action of the spring 68. In this way, the corrugated fin 21 is cut.

As can be seen from the above explanations, in the case of the cutter 24 illustrated in the drawings, the corrugated fin 21 can be cut every arbitrary number of ridges which is a multiple of 5.

The cutter 24 of the example illustrated in the drawings is described here under the following conditions:

In order to cut the corrugated fin 21 for use in a radiator, the tooth cutout portions 27 of the feed gear 26 are provided every 5 ridge of the feed gear 26, and the corrugated fin 21 is cut, for example, every 5 ridges of the corrugated fin 21.

However, in the present invention, the number of ridges of the corrugated fin 21 by which the corrugated fin 21 is cut is not an essential problem. For example, it is possible to design the cutter 24 in such a manner that the corrugated fin 21 can be cut by an arbitrary number of ridges such as 3, 4, 6, . . . . When consideration is given to the mechanical strength of the feed gear 26 and the use of the continuous corrugated strip 21, it is common that the number of ridges chosen is designed to be 4 to 6. However, it is possible to design the cutter 24 in such a manner that the corrugated fin can be cut by an arbitrary number of ridges, but is not less than 2.

I claim:

1. A cutter for cutting a continuous corrugated strip comprising:

a frame;

a feed gear rotatably supported by said frame, said feed gear being provided with a tooth portion on its outer circumference so as to be engaged with a continuous corrugated strip to be cut, a tooth cutout portion being formed in a portion of said outer circumference;

a rotary feed means for rotating said drive gear;

a first cutting blade unit having at least one first cutting blade capable of projecting from said tooth cutout portion of said feed gear, said first cutting blade unit being capable of rotating on an axis eccentric to the center of said feed gear;

a rotary drive means for rotating said first cutting blade unit synchronously with the rotation of said feed gear; and a second cutting blade which is opposed to an edge of said first cutting blade and shears said continuous corrugated strip in cooperation with said first cutting blade when said first cutting blade is projected from said tooth cutout portion of said feed gear.

2. The cutter for cutting a continuous corrugated strip according to claim 1, wherein said first cutting blade is radially provided in said first cutting blade unit.

3. The cutter for cutting a continuous corrugated strip according to claim 1, wherein said first and second cutting blades have first and second blade portions, respectively, which can abut one another, wherein one of said first and second blade portions is provided in parallel with an axial direction of said feed gear, and the other of said first and second blade portions is provided so as to be inclined relative to the axial direction of said feed gear.

4. The cutter for cutting a continuous corrugated strip according to claim 1, wherein one of said first and second cutting blades is pushed towards the other by a resilient member when said continuous corrugated strip is cut by said first and second cutting blades.

5. The cutter for cutting a continuous corrugated strip according to claim 1, wherein a clearance groove is formed on the outer circumference of said feed gear, and a guide member to guide said continuous corrugated strip to said feed gear is inserted into said clearance groove.

6. The cutter for cutting a continuous corrugated strip according to claim 1, wherein said second cutting blade is mounted on a lever pivotally attached to said frame being pushed towards said first cutting blade by a spring, and said second cutting blade is reciprocated by the action of a cam resisting a force applied by said spring.

7. The cutter for cutting a continuous corrugated strip according to claim 4, wherein said second cutting blade is mounted on a lever pivotally attached to said frame being pushed towards said first cutting blade by a spring, and said second cutting blade is reciprocated by the action of a cam resisting a force applied by said spring.

* * * * *